US008783362B2

(12) United States Patent
Adamek

(10) Patent No.: US 8,783,362 B2
(45) **Date of Patent: *Jul. 22, 2014**

(54) BELLOWS TYPE ADJUSTABLE CASING

(75) Inventor: Frank C. Adamek, Spring, TX (US)

(73) Assignee: Vetco Gray Inc., Houston, TX (US)

( * ) Notice: Subject to any disclaimer, the term of this patent is extended or adjusted under 35 U.S.C. 154(b) by 360 days.

This patent is subject to a terminal disclaimer.

(21) Appl. No.: 12/957,163

(22) Filed: Nov. 30, 2010

(65) Prior Publication Data

US 2011/0067880 A1 Mar. 24, 2011

Related U.S. Application Data

(63) Continuation-in-part of application No. 12/332,817, filed on Dec. 11, 2008, now Pat. No. 8,387,707.

(51) Int. Cl.
*E21B 17/01* (2006.01)

(52) U.S. Cl.
USPC ..... 166/367; 166/338; 166/355; 166/346

(58) Field of Classification Search
USPC ..... 166/339, 345, 346, 350–355, 367, 166/384–385; 405/224.2–224.5
See application file for complete search history.

(56) References Cited

U.S. PATENT DOCUMENTS

| | | | | |
|---|---|---|---|---|
| 3,459,259 | A * | 8/1969 | Matthews | 166/358 |
| 3,612,176 | A * | 10/1971 | Bauer et al. | 166/359 |
| 4,176,863 | A | 12/1979 | Wetmore | |
| 4,195,865 | A | 4/1980 | Martin | |
| 4,278,277 | A * | 7/1981 | Krijgsman | 285/93 |
| 4,548,273 | A | 10/1985 | Leicht et al. | |
| 4,598,936 | A | 7/1986 | Doll et al. | |
| 4,753,554 | A * | 6/1988 | Jeter | 405/224.2 |
| 4,761,023 | A | 8/1988 | Troxell, Jr. | |
| 4,819,967 | A | 4/1989 | Calder et al. | |
| 5,240,081 | A * | 8/1993 | Milberger et al. | 175/8 |
| 5,363,920 | A * | 11/1994 | Alexander et al. | 166/350 |
| 6,513,837 | B2 | 2/2003 | Fujikawa et al. | |
| 2010/0147530 | A1 | 6/2010 | Adamek et al. | |

FOREIGN PATENT DOCUMENTS

| | | | | |
|---|---|---|---|---|
| CN | 101333917 | A | 12/2008 | |
| EP | 2180133 | A1 * | 4/2010 | F16L 51/02 |

OTHER PUBLICATIONS

GB Search Report dated Feb. 2, 2012 from corresponding Application No. GB1120136.5.

* cited by examiner

*Primary Examiner* — James Sayre
(74) *Attorney, Agent, or Firm* — Bracewell & Giuliani LLP

(57) ABSTRACT

A subsea assembly for producing fluids from a well having a casing string in the well supported with a hanger on an upper end. Cement is in a portion of an annulus between the casing string and walls of the well, thereby leaving segment of the casing string unsupported in the well. A motion compensating element is coaxially provided in the unsupported segment of the casing string to absorb axial expansion and/or contraction that may occur in the unsupported segment of the casing string.

12 Claims, 5 Drawing Sheets

BELLOWS TYPE ADJUSTABLE CASING

CROSS REFERENCE TO RELATED APPLICATIONS

This application is a continuation-in-part of and claims priority from co-pending U.S. application having Ser. No. 12/332,817, filed Dec. 11, 2008, the full disclosure of which is hereby incorporated by reference herein.

BACKGROUND

1. Field of Invention

The device described herein relates generally to the production of oil and gas. More specifically, the device described herein relates to an expandable and/or contractable tensioning device for a tie-back assembly.

2. Description of Related Art

Some offshore platforms have a production tree or trees above the sea surface on the platform. In this configuration, a casing string extends from the platform housing to a subsea wellhead housing disposed on the seafloor. Production casing inserted within the wellbore is supported on the subsea floor by a hanger in the subsea housing. The casing string between the subsea and surface wellhead housings is tensioned to prevent flexure that may be caused by thermal expansion from heated wellbore fluids or vibration from applied side loads. Additionally, the string length or height is typically adjusted to seat or land the upper casing hanger within a surface wellhead.

A sub assembly can be attached to the casing string and used to tension the casing string and adjust its length. The sub assemblies typically comprise a pair of mated housings that in response to an applied force are mechanically retractable in length The adjustable sub assemblies connect inline within the string or on its upper end and when retracted impart a tension force on the casing string and by its retraction, shortening the casing string length.

SUMMARY OF INVENTION

Disclosed herein is a subsea assembly for carrying fluids from a subsea wellbore. In an example embodiment the subsea assembly is made up of a tubular member that is inserted into the wellbore. A hanger mounts on a lower end of the tubular member for supporting a casing string in the wellbore. An axially expandable and contractable member is formed in the casing string so that when the easing string axially expands or contracts, the axially expandable and contractable member can absorb the expansion or contraction so that stresses are not imparted onto the hanger. In an example embodiment, the expandable and contractable member is made of a uni-body tubular, where a wall of the tubular axially expands and contracts a greater amount per linear increment than the casing string. Optionally, the wall of the axially expandable and contractable member has a series of slots along the wall length alternatingly formed about the wall inner circumference and about the wall outer circumference; each slot can lie in a plane substantially perpendicular to an axis of the member. In an alternate embodiment, the expandable and contractable member includes annular foldable segments coaxially stacked along an axis of the member. Optionally, the foldable segments can have an "S" shaped cross section and the segment outer and inner diameter can vary along the member axis length. In another alternative, the expandable and contractable member has a wall with a bellows like shape or may be a helix forming a corrugated pattern along a surface of the wall. A support sleeve may optionally be included that circumscribes at least a portion of the expandable and contractable member. In an example embodiment, the tubular is a conductor pipe mounted in a wellhead housing set on the sea surface. Alternatively, the tubular is a conductor pipe mounted to the sea surface and the hanger is below a mudline on the seafloor.

BRIEF DESCRIPTION OF DRAWINGS

Some of the features and benefits of the present invention having been stated, others will become apparent as the description proceeds when taken in conjunction with the accompanying drawings, in which.

While the invention will be described in connection with the preferred embodiments, it will be understood that it is not intended to limit the invention to that embodiment. On the contrary, it is intended to cover all alternatives, modifications, and equivalents, as may be included within the spirit and scope of the invention as defined by the appended claims.

DETAILED DESCRIPTION OF INVENTION

The present invention will now be described more fully hereinafter with reference to the accompanying drawings in which embodiments of the invention are shown. This invention may, however, be embodied in many different forms and should not be construed as limited to the illustrated embodiments set forth herein; rather, these embodiments are provided so that this disclosure will be thorough and complete, and will fully convey the scope of the invention to those skilled in the art. Like numbers refer to like elements throughout.

Figure 1:
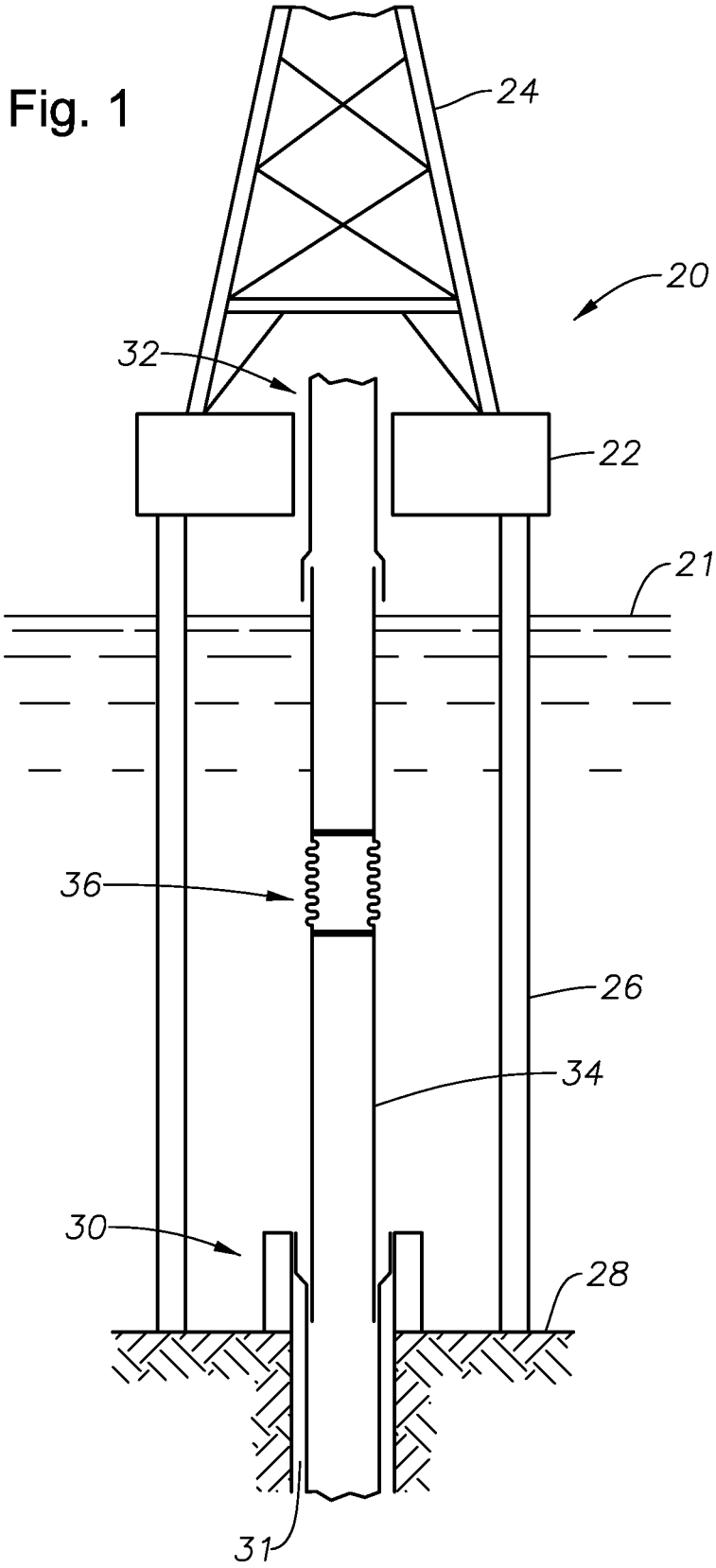
FIG. 1 is a side view of an offshore platform with a casing string extending to the seafloor, the casing string having a tensioning device.

With reference now to FIG. 1, provided therein is an example of an offshore platform 20 in a side view. The offshore platform 20 comprises a deck 22 situated above the level of the sea surface 21 with a derrick structure 24 attached atop the deck 22. Support legs 26 extend from the bottom of the deck 22 and attach on the sea floor 28. A subsea wellhead 30 is formed over a wellbore 31. A tieback casing string 34 extends upward from the subsea wellhead 30 and is coupled with a surface wellhead 32 disposed within the deck 22. In line with the casing string 34 is a tubular compensating member 36. The compensating member 36 may be integrally formed within the tieback casing string 34. Optionally, the compensating member 36 may be formed separately from the tieback casing string 34 and later attached therein such as by a weld, threaded connection, or flanged connection. The compensating member 36 can compensate for tieback casing string 34 length changes while maintaining a substantially constant axial stress in the tieback casing string 34. Alternatively, the compensating member 36 may be connected on one end to the riser 34 terminal upper or lower end and on its other end to either the surface wellhead 32 or subsea wellhead 30. The compensating member 36 can be coupled with any riser and is not limited to use with a tieback casing string. The compensating member 36 may be exposed to the seawater or may be enclosed inside additional casing strings. Other examples include tubing, subsea transfer lines, subsea flowline connections, and tubular members inserted within a wellbore.

The compensating member 36 is axially compressive or axially expandable in response to an applied axial force. The member 36 compresses or expands depending on the magnitude of the applied force and its direction. As noted above, a tieback casing string 34 typically remains in tension during operation. Accordingly, the member 36 can be compressed in response to casing string 34 (or other riser) elongation without removing tension from the casing string 34.

Figure 2:
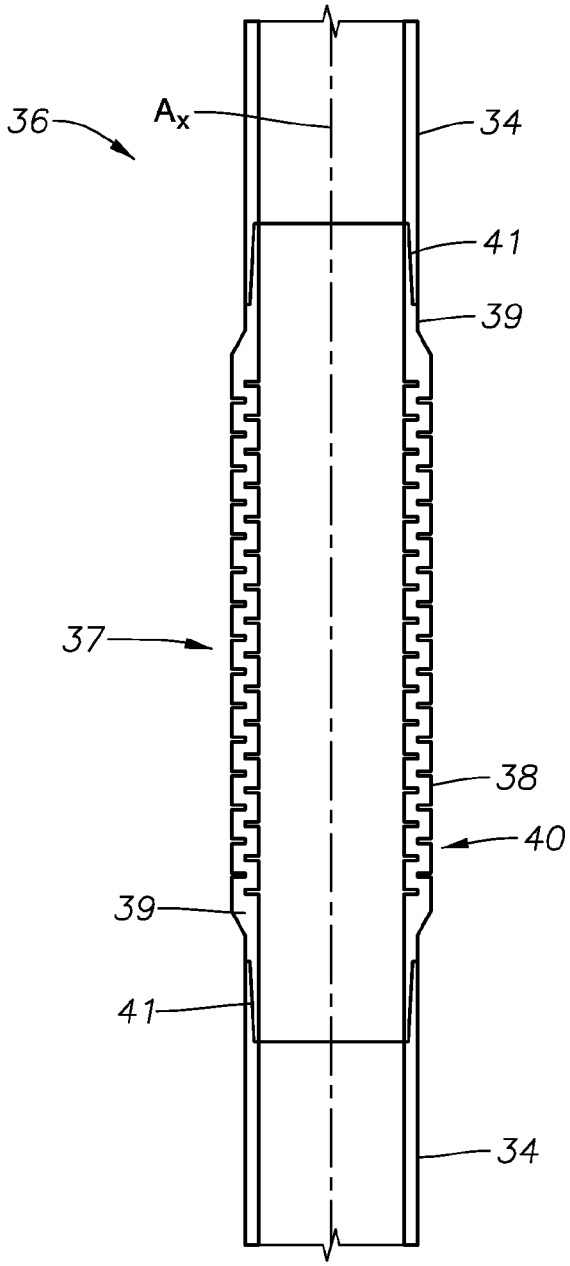
FIG. 2 is a side cutaway view of an embodiment of a tensioning device.

With reference now to FIG. 2, illustrated therein is a sectional view of an embodiment of the compensating member 36. In this embodiment, the compensating member 36 includes a body 37 and leads 39. The leads 39 extend from opposite ends of the body 37 for connecting the body 37 to the casing string 34. Threaded connections 41 are shown on the free end of the leads 39; however welds or flanges could be used for connecting to the casing string 34. When formed integral with the casing string 34, the compensating member 36 may optionally not include specific connections to the casing string 34. The body 37 transitions from a smaller thickness adjacent the leads 39 to a larger thickness along its mid portion to form a wall 38 between the transitions. The wall 38 cross section is contoured in a repeating "S" or "Z" shaped pattern. The pattern may be created by forming slots 40 into the inner and outer circumference of the wall 38. Strategically alternating the slots 40 between the wall 38 inner surface and wall 38 outer surface along the body 37 axis $A_X$ forms the "S"/"Z" shaped pattern.

Figure 3:
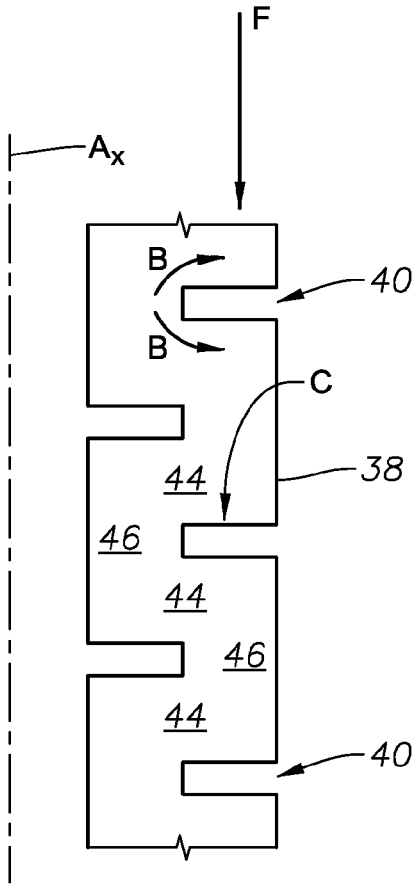
FIG. 3 depicts an enlarged portion of the tensioning device of FIG. 2.

Incorporating the slots 40 alters the wall 38 cross sectional structure. As illustrated in an enlarged view in FIG. 3, the wall 38 cross section comprises a series of members 44 each having a web element 46 from each end and extending therefrom in an opposite direction. The member 44 to web element 46 connection is analogous to a cantilever connection C. The members 44 are shown aligned substantially parallel to one another arranged perpendicular to the web elements 46 and the body 37 axis $A_X$. However other embodiments exist wherein one or more members 44 are arranged oblique to one or more of the other members 44, oblique to one or more of the web elements 46, or oblique to the body 37 axis $A_X$. Optionally, one or more web elements 46 may be oblique to the body 37 axis $A_X$.

Unlike a solid tubular, an axial force F initially applied to the wall 38 does not produce an evenly distributed stress across the wall thickness. Instead the resulting stress concentrates at the cantilevered connections C between the member 44 and web element 46 thereby exerting a bending moment B about the connection C. A sufficient bending moment B on a member 44 deflects the member 44 toward an adjacent slot 40 that in turn shortens the wall 38 and member 36 length. Similarly, an axial force applied in a direction opposite to the force F produces oppositely oriented bending moments that increase the slot 40 width to lengthen the member 36. It should be pointed out that the compensating member 36 configuration described herein is designed to deflect, either in compression or tension, before applied forces approach the yield strength of the riser 34 or other components. As such, the compensating member 36 expands or compresses at a linear increment less than the linear expansion/compression of the riser Due to the dynamic nature of the expanding and contracting riser 34, the wall 38 material should be sufficiently deformable to accommodate such dynamic loading; where the deformation can be elastic or plastic. As is known, the number of members 44 deflecting, and by how much depends on the force F magnitude, the wall 38 and slot 40 dimensions, and wall 38 material. Thus the body 37 material, slot 40 dimensions, number of slots 40, and wall 38 thickness depend on the anticipated tieback attachment operating conditions. However, those skilled in the art are capable of estimating these variables. In the embodiment shown, the body 37 primarily comprises a single member thereby having a uni-body construction. In this embodiment, the body 37 itself expands and contracts to maintain riser tension without relative movement between two or more coupled members.

Figure 4:
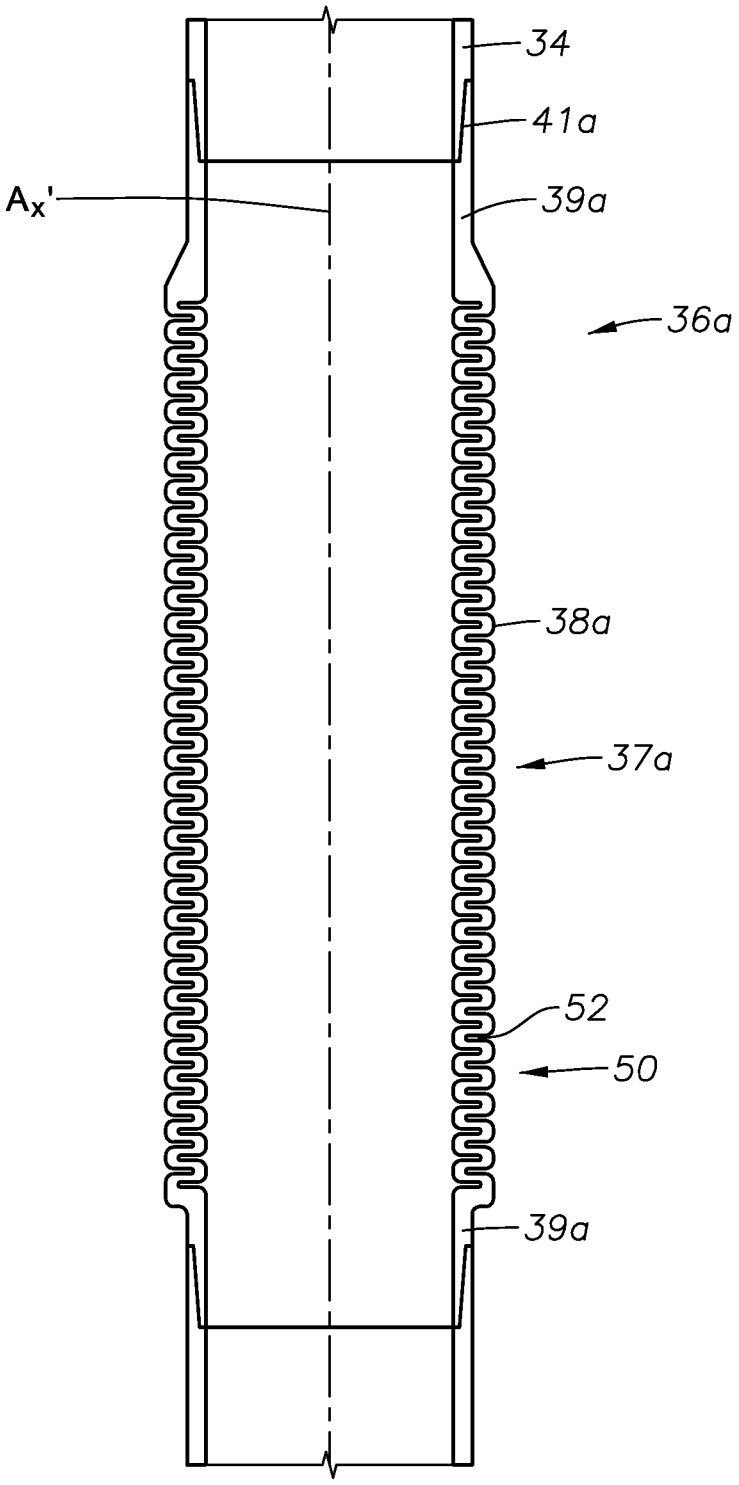
FIG. 4 is a side cutaway view of an alternative embodiment of a tensioning device

FIG. 4 depicts an alternative compensating member **36*a* in a side sectional view. In this embodiment, the compensating member 36*a* includes a body 37*a*, leads 39*a* for attaching the body 37*a* to the riser 34, and a wall 38*a* between transitions adjacent the leads 39*a*. In this embodiment the wall 38*a* cross section illustrates a series of folds resembling a repeating series of undulations 50. The undulations 50 have a generally "U" shaped cross section comprising a first and second portion oriented generally perpendicular to the body 37*a* axis $A_X'$ joined by a base portion, where the base portion runs generally parallel to the body 37*a* axis $A_X'$. Spaces 52** are defined in the area between each respective first and second portion.

Referring still to FIG. 4, the folds circumscribe the body **37*a* axis $A_X'$ in annular sections sequentially stacked along the body 37*a* length; the annular sections lie in a plane substantially perpendicular to the axis $A_X'$. Similar to the wall 38 of FIG. 2, the wall 38*a* of FIG. 4 can respond to the expansion or contraction of the casing string 34 by correspondingly expanding or contracting while retaining sufficient tension in the casing string 34. Alternatively the compensating member 36*a* wall 38*a* of FIG. 4 is formed into a bellows or bellows like structure. In another embodiment, the folds are formed by a pair of axially spaced apart helixes axially formed in the inner and outer wall 38*a* circumference. The helixes circumferentially traverse the body 37*a*** extending between the transitions.

Figure 5:
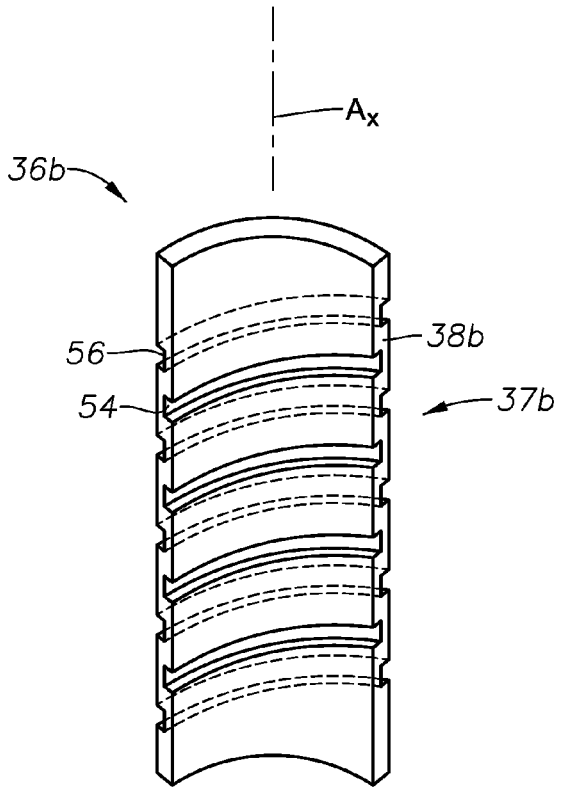
FIG. 5 is a sectional perspective view of an alternative embodiment of a tensioning device.

Shown in a sectional perspective view in FIG. 5 is a portion of another embodiment of a motion compensation member **36*b*. In this embodiment helical grooves 54, 56 are formed along the body 37*b*. More specifically, an inner helical groove 54 is formed on the inner surface of the wall 38*b* with a corresponding outer helical groove 56 formed along the wall 38*b* outer surface. The grooves 54, 56 are shown staggered along the member 36*b* axis $A_X$ thereby forming an "S" or "Z" shaped cross section similar to the embodiment of FIG. 2. Embodiments exist having a single helical groove either on the inner or outer wall 38*b* surface. Optionally, the body 37*b*** could comprise multiple helically grooves along its surfaces, i.e. inner, outer, or both.

Figure 6:
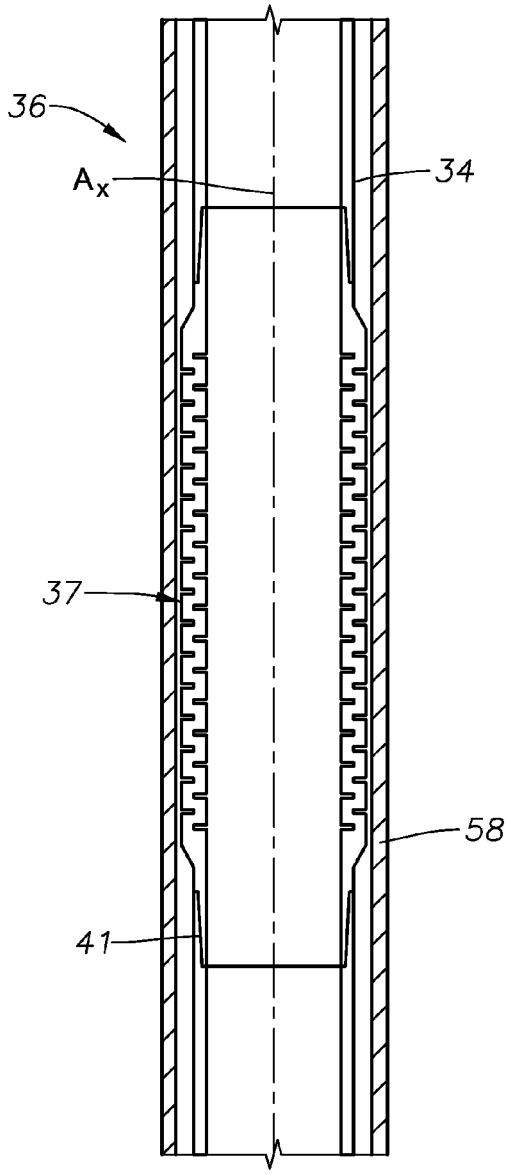
FIG. 6 is a side sectional view of an embodiment of a tensioning device having an outer support sleeve.

FIG. 6 depicts an optional support sleeve 58 circumscribing the body 37. The support sleeve 58 may be included to add structural support to the motion compensation member 36, especially loading tangential to the axis $A_X$. The support sleeve 58 may comprise a single tubular member or multiple elements disposed along the body 37. The sleeve 58 may be comprised of any material capable of adding strength to the body 37, examples include steel, alloys, and composite materials. The sleeve 58 is preferably secured on its upper end to the, surface wellhead 32, to the platform 22, to the tieback string 34 between the body 37 and the surface wellhead 32, or to another similar structure. Optionally, the sleeve 58 can be anchored at its bottom end to the wellhead 30, tieback string 34 between the body 37 and the wellhead 30, or another similar structure.

In one example of use of the device described herein, casing string 34 and compensating member 36 are affixed between seafloor wellhead 30 and surface wellhead 32 and axially tensioned. Sufficient tension in the compensating member 36, 36*a* elastically deforms the wall 38, 38*a* and increases the slot/space 40, 52 thickness that in turn elastically elongates the compensating member 36. Since the compensating member 36, 36*a* is elastically deformed, the compensating member 36, 36*a* can compress to a less elongated state and compensate for casing string 34 elongation due to high temperature fluid exposure. Optionally, the actual tension applied to the casing string 34 and compensating member 36, 36*a* may exceed the required casing string 34 stabilizing value. Thus the casing string 34 tension can remain above its required value after any tension force reduction experienced by compensating member 36 compression.

Figure 7:
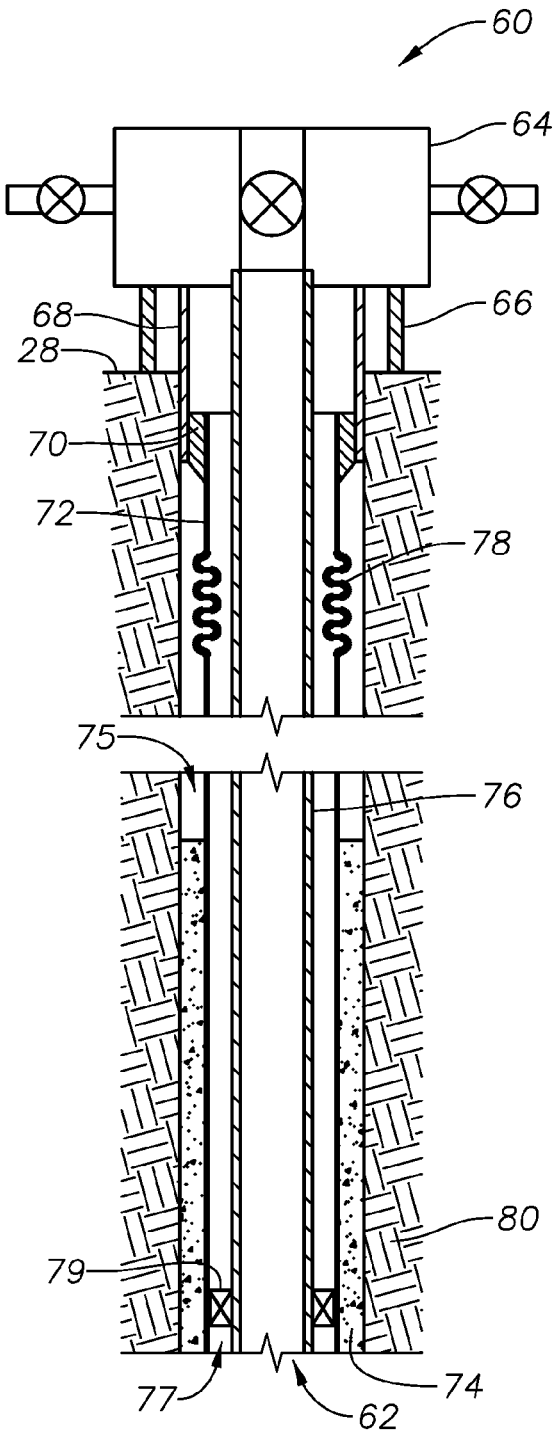
FIG. 7 is a side partial sectional view of an example embodiment of a subsea wellhead assembly having a string of casing that includes a motion compensator.

Referring now to FIG. 7, an example embodiment of a wellhead assembly 60 over a subsea wellbore 62 is shown in a side partial sectional view. The wellhead assembly 60 includes a production tree 64 for controlling production flow from the wellbore 62 and selectively enabling access to within the wellbore 62. Below the production tree 64 and set into the seafloor 28 is an outer housing 66 that circumscribes the opening of the wellbore 62. A conductor pipe 68 depends from within the outer housing 66 and a distance into the wellbore 62. Shown landed in an inner circumference of the conductor pipe 68 is a casing hanger 70; that in turn supports a string of casing 72 shown projecting into the wellbore 62. Cement 74 is shown in a lower portion of an annulus 75 formed between the casing 72 and borehole 62. Production tubing 76 is provided coaxially within the casing 72 and depending from a tubing hanger (not shown) within the wellhead assembly 60.

Produced fluids (not shown) from the formation 80 adjacent the borehole 62 flow through the production tubing 76 to the production tree 64, that directs the fluids for collection and processing. The produced fluid is typically warmer than the casing 72 and as such can warm the casing 72 via heat transfer through the annulus 77 between the tubing 76 and casing 72. The annulus 77 can sometimes contain fluids that promote the heat transfer to the casing 72. As is known, when heated, the casing 72 will thermally expand; and with enough axial expansion can exert an upward force against the hanger 70. In the embodiment of FIG. 7, a portion of the casing 72 is free or unsupported, that is, not circumscribed by cement 74. When the length of free casing is substantial, such as 1000 feet or more, sufficient axial thermal expansion can occur to unseat the hanger 70. A compensating member 78 is shown provided with the embodiment of FIG. 7 that axially deforms in response to thermal expansion within the casing 70. The compensating member 78 is shown coupled inline with the casing 72 at a location below where the casing 72 attaches to the hanger 70. However, the compensating member 78 can be disposed at any location along the portion of free or unsupported casing 72 and below the hanger 70. Although a single compensating member 78 is illustrated, a plurality of members 78 may be included in the casing 72. In an example embodiment, the compensating member 78 is substantially the same as the compensating members described above and illustrated in FIGS. 1-6. Also shown in FIG. 7 is a packer 79 for isolating the inner annulus 77 from pressure in the wellbore 62.

Figure 8:
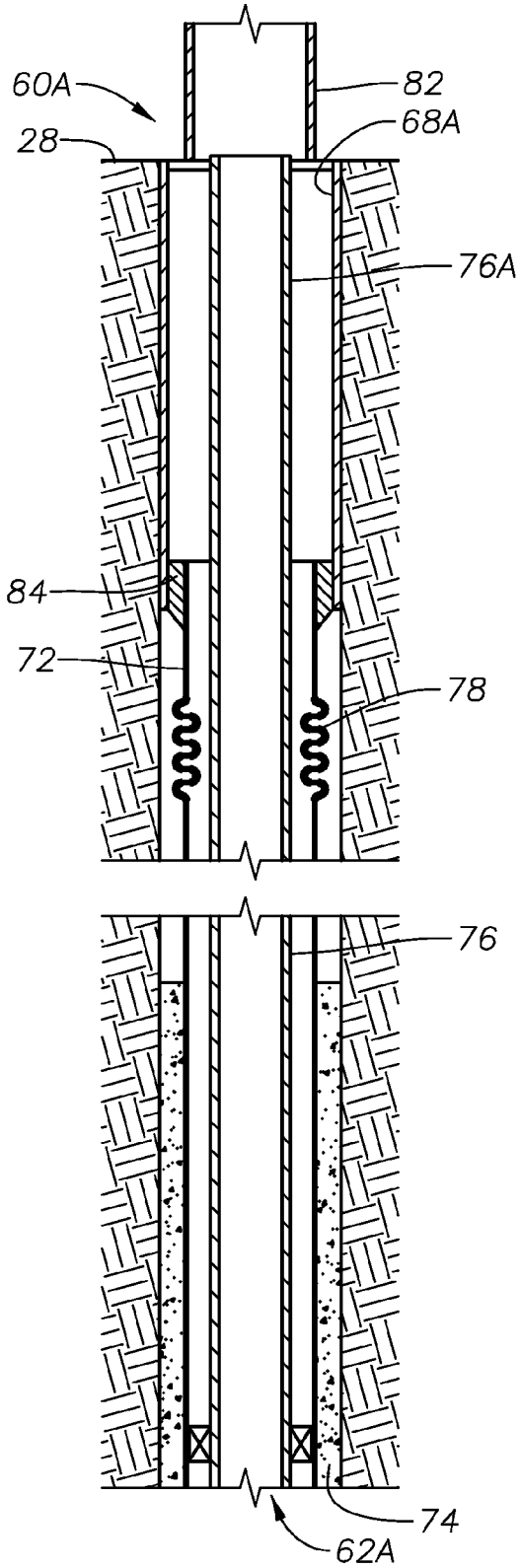
FIG. 8 is a side partial sectional view of an example embodiment of a subsea well with a string of casing that includes a motion compensator.

Referring now to FIG. 8, an alternate embodiment of a wellhead assembly 60A is illustrated in a side sectional view. A subsea tree is not included with this example, instead a riser 82 projects upward from the opening of the wellbore 62A for carrying production fluid to above the sea surface. Conductor pipe 68A, which is supported on the sea floor 28, inserts into the wellbore 62A for holding the casing 72 within the wellbore 62A. A mudline hanger 84 couples the upper end of the casing 72 on the lower end of the conductor pipe 68A. Similar to the embodiment of FIG. 7, cement 74 is provided in a portion of the annulus 75 between the casing 72 and inner wall of the wellbore 62A, thereby leaving an amount of casing 72 unsupported. In the example embodiment of FIG. 8, a motion compensator 78 is installed in the section of unsupported casing 72 and below the mudline hanger 84. As such, any axial expansion of the casing 72 in the unsupported portion, such as through heating from production fluids in the tubing 76, will be absorbed within the motion compensator 78 and will not axially push against the mudline hanger 84.

One of the advantages presented by the compensating member described herein is that it can be comprised of a single member formed into a uni-body construction. Moreover, each of the compensating member embodiments presented are formable into a single unit. The uni-body construction eliminates additional components that can complicate manufacture as well as increase failure modes and percentages of failure.

It is to be understood that the invention is not limited to the exact details of construction, operation, exact materials, or embodiments shown and described, as modifications and equivalents will be apparent to one skilled in the art. In the drawings and specification, there have been disclosed illustrative embodiments of the invention and, although specific terms are employed, they are used in a generic and descriptive sense only and not for the purpose of limitation. Accordingly, the invention is therefore to be limited only by the scope of the appended claims.

What is claimed is:

1. A subsea assembly for carrying fluids from a subsea wellbore comprising:

an outer tubular inserted in an opening of the wellbore;

a hanger mounted on a lower end of the outer tubular;

a casing string depending from the hanger into the wellbore; and an axially expandable and compensating member provided along a portion of the casing string having a wall with undulations that comprise a series of slots along a length of the wall alternatingly formed about an inner circumference and about an outer circumference of the wall, each slot lying in a plane substantially perpendicular to an axis of the compensating member, the slots defining a series of cantilevers along a length of the body that are bendable when the body is axially compressed and that are bendable when the body is axially elongated, so that when casing above the compensating member is supported in tension the body transmits the tension to the casing below the compensating member.

2. The subsea assembly of claim 1, wherein the compensating member axially expands and contracts a greater amount per linear increment than the casing string.

3. The subsea assembly of claim 1, wherein the cantilevers in the wall comprise annular foldable segments coaxially stacked along an axis of the compensating member.

4. The subsea assembly of claim 3, wherein the foldable segments have an "S" shaped cross section.

5. The assembly of claim 1, wherein the slots in the wall comprise helical grooves.

6. The subsea assembly of claim 1, further comprising a support sleeve circumscribing at least a portion of the compensating member and that is free of the tension transmitted through the compensating member.

7. The subsea assembly of claim 1, wherein the outer tubular comprises a conductor pipe mounted in a wellhead housing set on the sea surface.

8. The subsea assembly of claim 1, wherein the outer tubular comprises a conductor pipe mounted to the sea surface and the hanger is below a mudline on the seafloor.

9. A subsea assembly for carrying fluids from a subsea wellbore comprising:

a wellhead assembly comprising a production tree mounted on a wellhead housing a hanger mounted within the wellhead housing;

a casing string depending from the hanger into the wellbore; and a compensating member that is axially expandable and contractible provided along is portion of the casing string and having a body with a wall that includes undulations comprising a series of slots along a length of the wall alternatingly formed about an inner circumference and about an outer circumference of the wall, each slot lying in a plane substantially perpendicular to an axis of the compensating member, the slots defining a series of cantilevers along a length of the body that are bendable when the body is axially compressed and that are bendable when the body is axially elongated, so that when casing above the compensating member is supported in tension the body transmits the tension to the casing below the compensating member.

10. The subsea assembly of claim 9, wherein the compensating member further comprises a set of threads on each end of the body for connecting to upper and lower sections of the casing string wherein the wall has a greater thickness between the inner and outer diameter surfaces than portions of the body containing the threads.

11. A compensating casing sub mechanically coupleable between a tubular member and a second member, comprising:

a tubular body having a steel wall and an axis;

a first end adapted to be affixed to an end of the tubular member;

a second end adapted to be affixed to an end of the second member;

a series of compressible segments integrally formed in the wall of the body circumscribing the axis and sequentially arranged along a length of the body to enable the body to be compressed between the tubular member and the second member to absorb thermal expansion of the tubular member; and wherein the compressible segments are defined by a series of helical slots along a length of the wall alternatingly formed about an inner circumference and about an outer circumference of the wall, each helical slot lying in a plane substantially perpendicular to an axis of the compensating member, the helical slots defining a series of cantilevers along a length of the body that are bendable when the body is axially compressed and bendable when the body is axially elongated.

12. The compensating casing sub of claim 11, wherein the second member is adapted to be secured to a wellhead member and compression of the compensating casing sub reduces stress between the second member and the wellhead member due to thermal expansion of the tubular member.

* * * * *